US009345296B1

(12) United States Patent
Lanear

(10) Patent No.: US 9,345,296 B1
(45) Date of Patent: May 24, 2016

(54) WALKING AID WITH DETERRENT SPRAY

(71) Applicant: Lynn Lanear, Orlando, FL (US)

(72) Inventor: Lynn Lanear, Orlando, FL (US)

( * ) Notice: Subject to any disclaimer, the term of this patent is extended or adjusted under 35 U.S.C. 154(b) by 0 days.

(21) Appl. No.: 14/848,424

(22) Filed: Sep. 9, 2015

(51) Int. Cl.

| | |
|---|---|
| ***A45B 3/14*** | (2006.01) |
| ***A45B 3/00*** | (2006.01) |
| ***F41H 9/10*** | (2006.01) |
| ***B05B 1/28*** | (2006.01) |

(52) U.S. Cl.
CPC ... *A45B 3/14* (2013.01); *A45B 3/00* (2013.01); *B05B 1/28* (2013.01); *F41H 9/10* (2013.01)

(58) Field of Classification Search
CPC ..... A45B 3/00; A45B 3/14; F41H 9/10; B05B 1/28
USPC ..... 239/288.5
See application file for complete search history.

(56) References Cited

U.S. PATENT DOCUMENTS

| | | | | | |
|---|---|---|---|---|---|
| 1,226,443 | A * | 5/1917 | Baker | B05B 1/14 | 222/174 |
| 2,941,695 | A * | 6/1960 | Rich | A45B 3/00 | 135/16 |
| 3,038,483 | A * | 6/1962 | Altsheler | A45B 3/00 | 135/16 |
| 3,485,206 | A * | 12/1969 | Smrt | B65D 83/203 | 118/305 |
| 4,860,776 | A * | 8/1989 | McQuain | A45B 3/00 | 135/16 |
| 4,865,257 | A * | 9/1989 | Bailey | B05B 1/28 | 239/288.5 |
| 5,065,904 | A * | 11/1991 | McCaffrey | F41H 9/10 | 135/19.5 |
| 5,170,943 | A * | 12/1992 | Artzberger | E02F 3/9206 | 137/625.27 |
| 5,477,431 | A * | 12/1995 | Curameng, Jr. | F41B 15/00 | 135/16 |
| 5,901,723 | A | 5/1999 | Ames | | |
| 6,957,750 | B1 | 10/2005 | Trudell | | |
| D544,201 | S | 6/2007 | Berl | | |
| 7,654,275 | B2 | 2/2010 | Ewell | | |
| 8,356,614 | B2 | 1/2013 | Forrester | | |
| 8,375,967 | B1 | 2/2013 | Stratton | | |
| 8,861,169 | B2 * | 10/2014 | Bradshaw | A01K 15/029 | 361/232 |
| 2010/0078051 | A1 * | 4/2010 | O'Neill | A45B 3/00 | 135/16 |

FOREIGN PATENT DOCUMENTS

WO WO2005045348 A1 5/2005

* cited by examiner

*Primary Examiner* — Robert Canfield
(74) *Attorney, Agent, or Firm* — Kyle A. Fletcher, Esq.

(57) ABSTRACT

The walking aid with deterrent spray is constructed of a walking cane that includes a deterrent spray member integrated onto a distal end. The deterrent spray member includes a shield that opens to prevent a deterrent spray from reaching an end user. The shield is collapsible when not in use. The walking cane includes a spray nozzle on a distal end, which disperses the deterrent spray in order to temporarily incapacitate a feral animal. The spray nozzle is connected to a replaceable canister that is positioned within the walking cane. A trigger is provided on a handle portion of the walking cane. The trigger is in mechanical connection with the replaceable canister in order to dispense the deterrent spray via the spray nozzle. The shield is actuated via a plurality of extension rods that translate and pivot via a locking collar.

13 Claims, 5 Drawing Sheets

WALKING AID WITH DETERRENT SPRAY

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

The present invention relates to the field of self-defense products and accessories, more specifically, a walking cane that doubles as a deterrent spray device.

Walking canes provide assistance to individuals with physical limitations. Dog owners need to walk their dogs. Stray feral animals can present a dangerous situation to either the dog owner and their respective pet.

What is needed and is accomplished via the device of the present application is a walking cane that is able to dispense a deterrent spray at a moments notice. The device of the present application addresses this need, and also provides a shield that can pop open on demand in order to prevent deterrent spray from reaching the end user in an emergency situation.

SUMMARY OF INVENTION

The walking aid with deterrent spray is constructed of a walking cane that includes a deterrent spray member integrated onto a distal end. The deterrent spray member includes a shield that opens to prevent a deterrent spray from reaching an end user. The shield is collapsible when not in use. The walking cane includes a spray nozzle on a distal end, which disperses the deterrent spray in order to temporarily incapacitate a feral animal. The spray nozzle is connected to a replaceable canister that is positioned within the walking cane. A trigger is provided on a handle portion of the walking cane. The trigger is in mechanical connection with the replaceable canister in order to dispense the deterrent spray via the spray nozzle. The shield is actuated via a plurality of extension rods that translate and pivot via a locking collar. The locking collar is able to slide along a cane shaft.

An object of the invention is to provide a walking cane that is able to dispense a deterrent spray from a distal end in order to defend an end user against a feral animal.

An even further object of the invention is to provide a shield that is able to extend upon release of a button in order to prevent the deterrent spray from reaching the end user.

Another object of the invention is to provide a walking operated, the deterrent spray is dispensed via a spray nozzle provided on a distal end of the cane shaft portion of the walking cane.

These together with additional objects, features and advantages of the walking aid with deterrent spray will be readily apparent to those of ordinary skill in the art upon reading the following detailed description of the presently preferred, but nonetheless illustrative, embodiments when taken in conjunction with the accompanying drawings.

In this respect, before explaining the current embodiments of the walking aid with deterrent spray in detail, it is to be understood that the walking aid with deterrent spray is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the walking aid with deterrent spray.

It is therefore important that the claims be regarded as including such equivalent construction insofar as they do not depart from the spirit and scope of the walking aid with phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
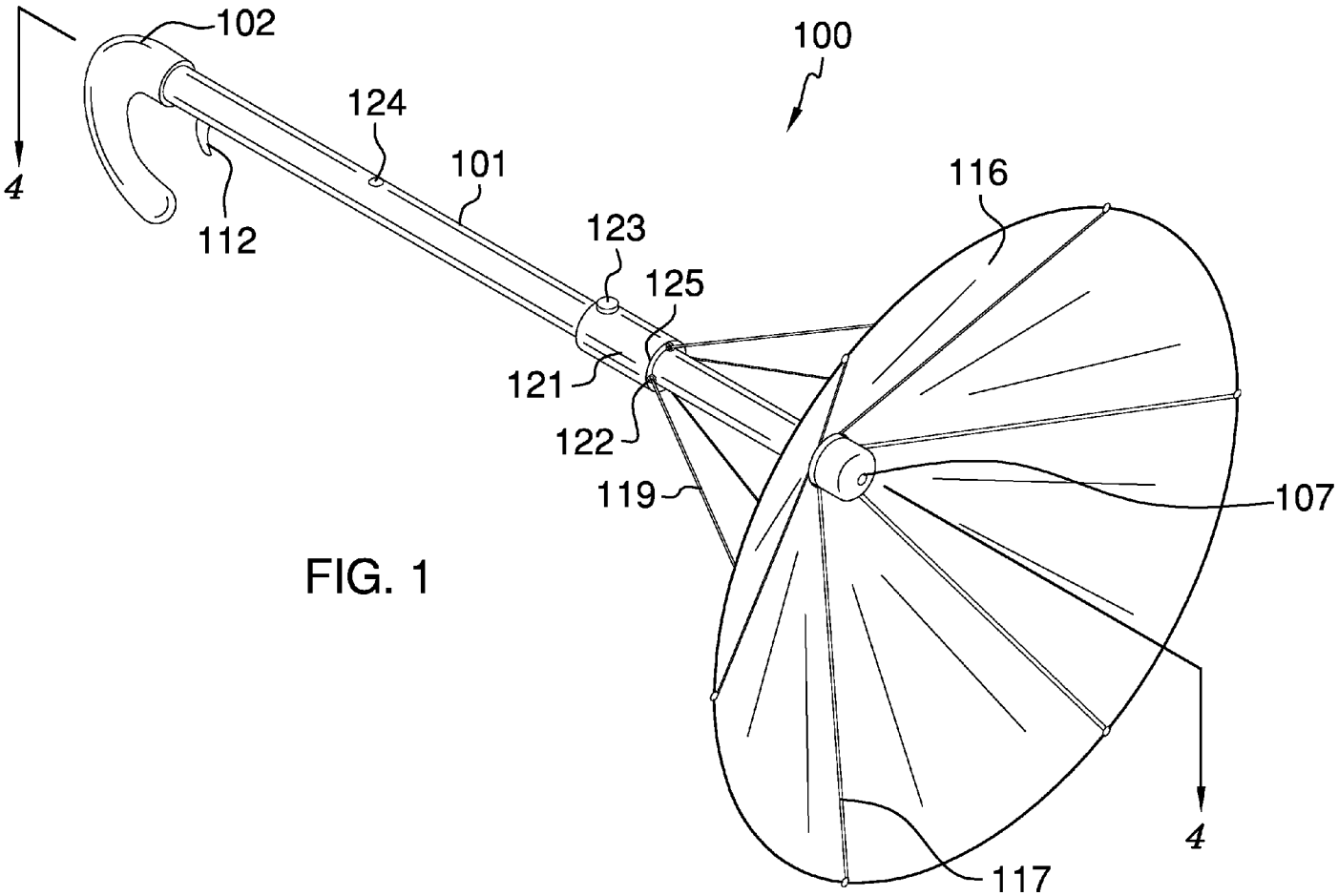
FIG. 1 is a perspective view of an embodiment of the disclosure.
Figure 2:
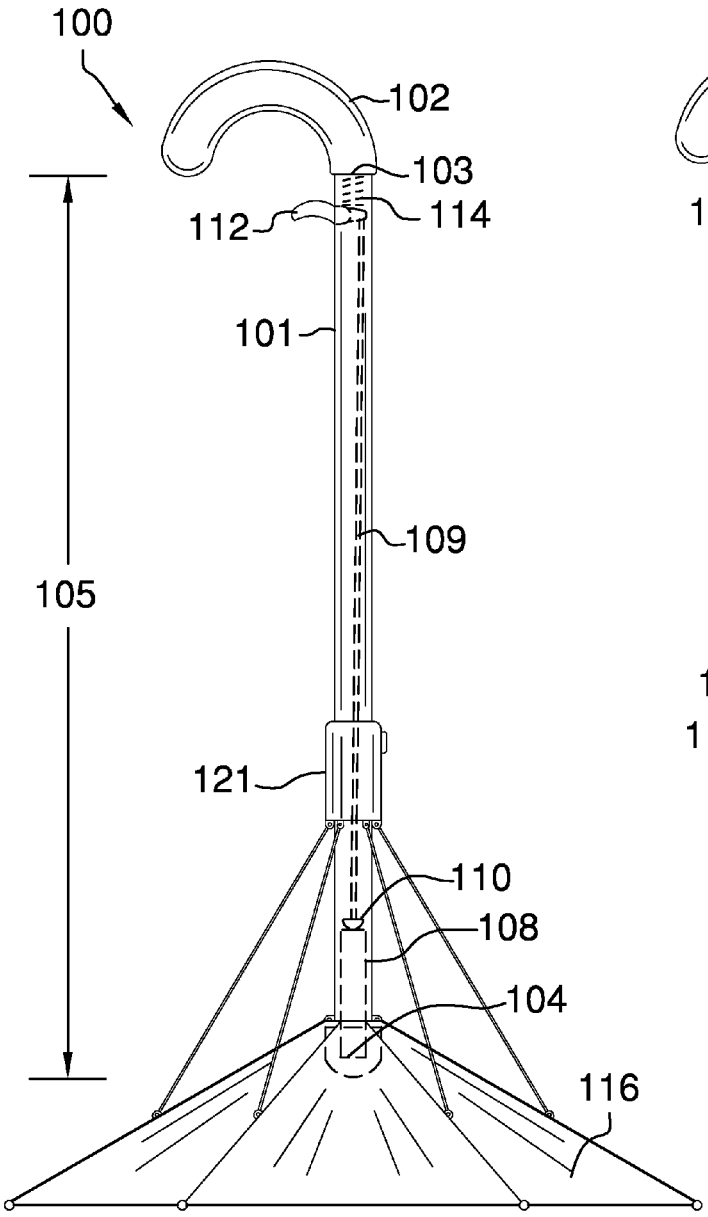
FIG. 2 is a side view of an embodiment of the disclosure.
Figure 3:
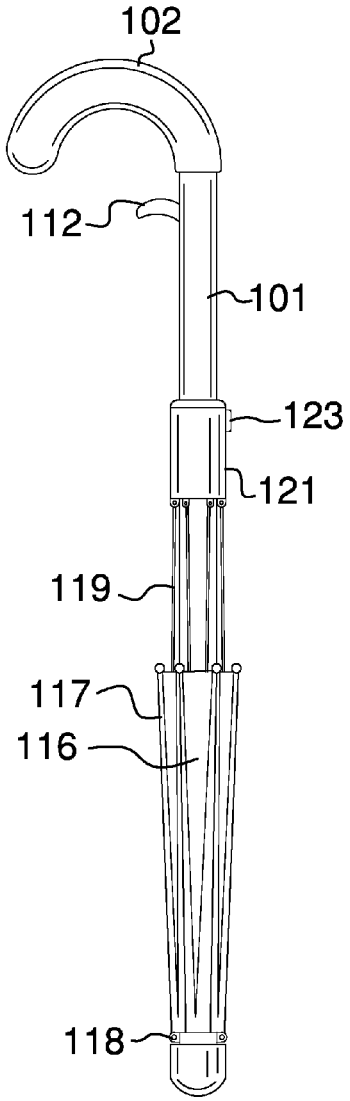
FIG. 3 is a second side view of an embodiment of the disclosure.
Figure 4:
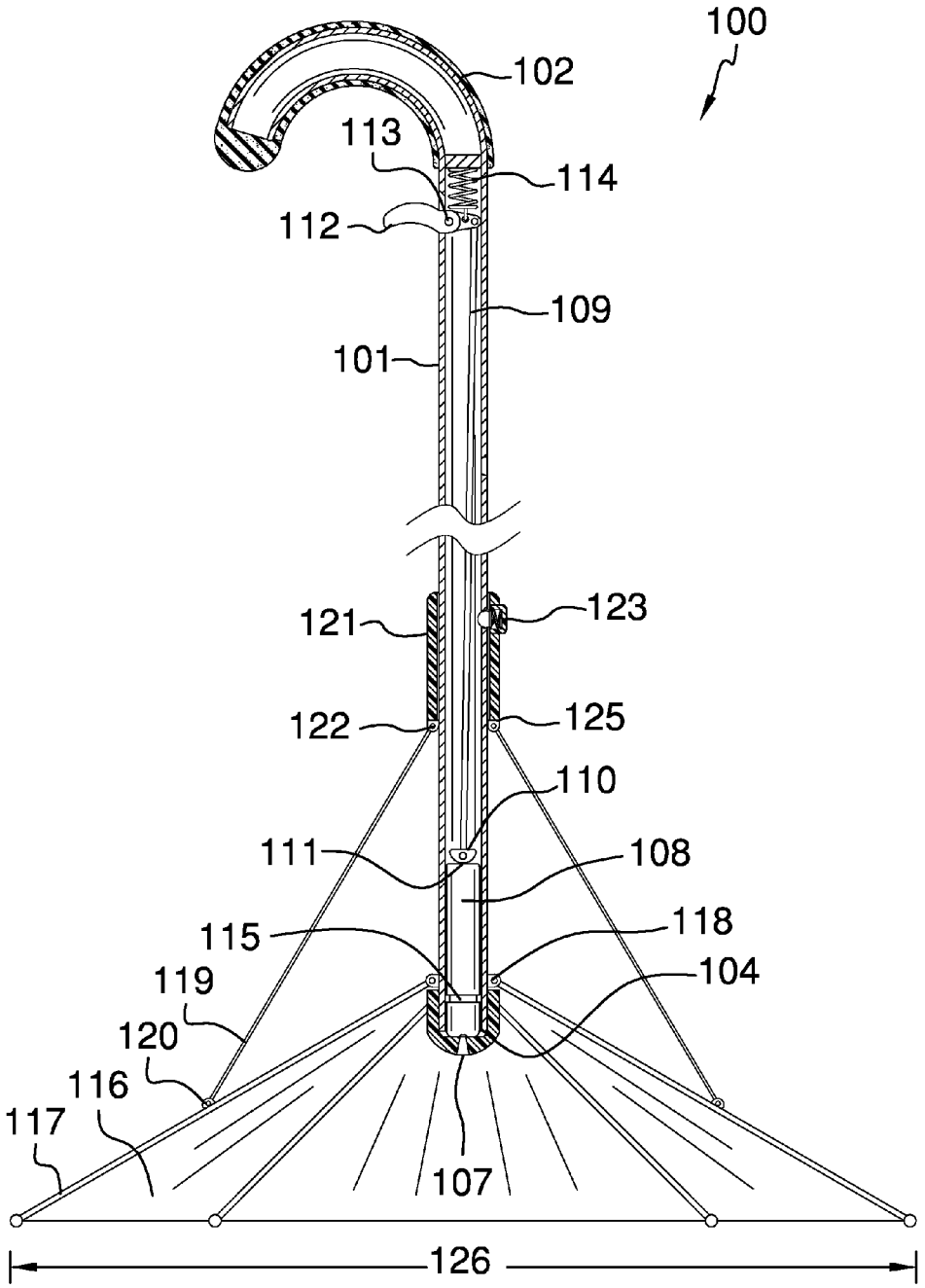
FIG. 4 is a cross-sectional view of an embodiment of the disclosure along line 4-4 in FIG. 1.
Figure 5:
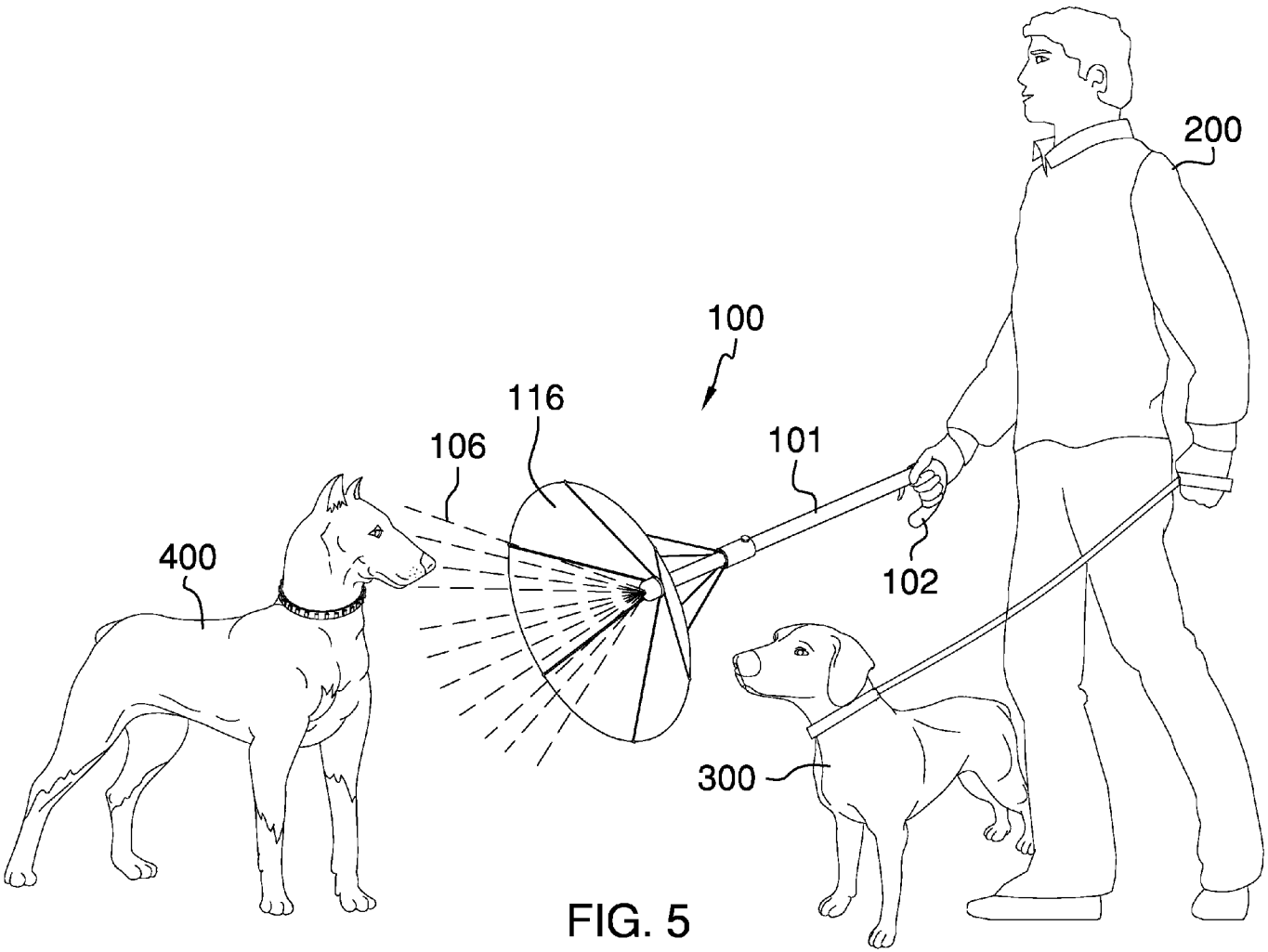
FIG. 5 is a detail view of an embodiment of the disclosure in use.
Figure 6:
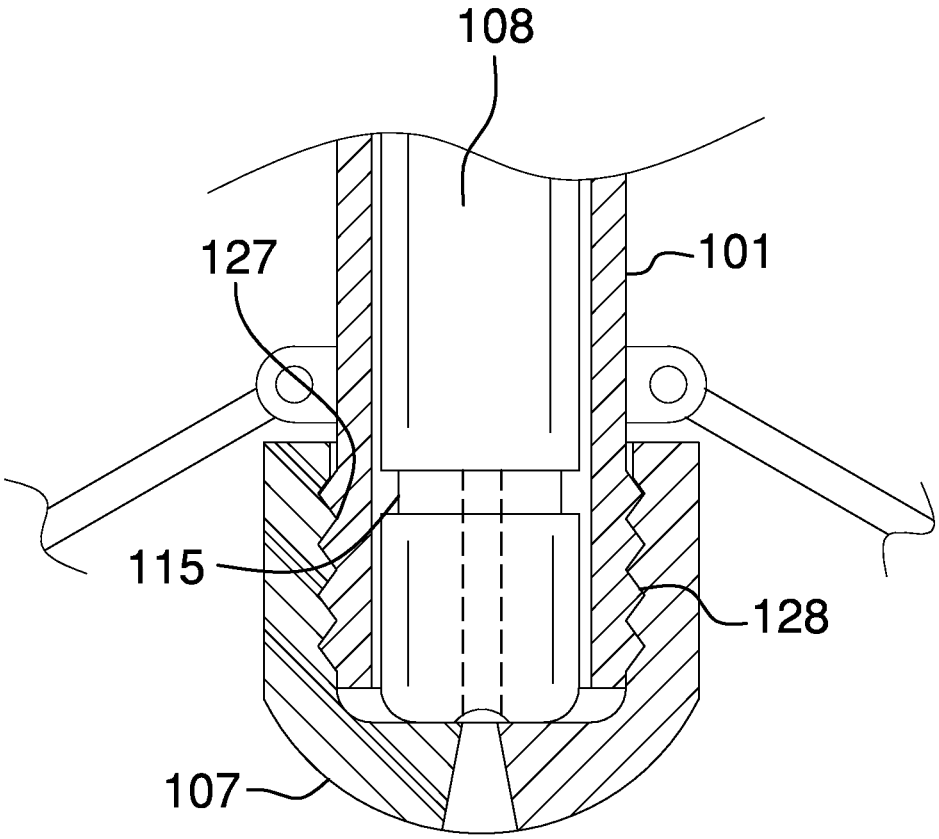
FIG. 6 is a detail view of an embodiment of the disclosure.

Detailed reference will now be made to a several potential embodiments of the disclosure, which is illustrated in FIGS. 1 through 6. The walking aid with deterrent spray 100 (hereinafter invention) includes a cane shaft 101 with a handle portion 102 provided at a top distal end 103 of the cane shaft 101. The cane shaft 101 is also further defined with a bottom distal end 104, and is partially or wholly of hollowed construction. The cane shaft 101 is further defined with a shaft length 105. The shaft an end user 200. The end user 200 is adapted to walk with the invention 100 via the handle portion 102.

It shall be noted that the end user 200 is ideally using the invention 100 in an emergency situation. Moreover, the end user 200 may be walking a dog 300 with the invention 100. Upon encountering a feral animal 400, the invention 100 may be further employed in order to temporarily incapacitate the feral animal 400 via a deterrent spray 106.

The cane shaft 101 includes a spray nozzle 107 that is provided at the bottom distal end 104. The spray nozzle 107 is able to dispense the deterrent spray 106. Moreover, the spray nozzle 107 is able to atomize and form a spray pattern in order to effectively target an area associated with the feral animal 400. It shall be further noted that the deterrent spray 106 may involve one of a plurality of different types of self-defense sprays comprising pepper spray, mace, tear gas, mustard gas, etc.

The spray nozzle 107 is in fluid connection with a replaceable canister 108 that is located within the cane shaft 101. The replaceable canister 108 is positioned behind the spray nozzle 107. Moreover, the replaceable canister 108 includes a spring-actuated stem 115 that upon depression releases the deterrent spray 106 from the replaceable canister 108 and out the spray nozzle 107.

The replaceable canister 108 is actuated via a linkage 109 that extends from the top distal end 103 of the cane shaft 101. The linkage 109 includes a cam 110 that engages a top canister surface 111 of the replaceable canister 108. The linkage 109 is attached to a trigger 112 provided adjacent the handle portion 102 of the invention 100. The trigger 112 pivots at a trigger pivot point 113. Moreover, the trigger 112 is biased via a trigger spring 114 located within the cane shaft 101. The trigger 112 is responsible for operation of the replaceable canister 108.

The cane shaft 101 also features a shield 116. The shield 116 is deployable at a moments notice. The shield 116 can expand and collapse (see FIGS. 2 and 3). The shield 116 is a conically-shaped canopy that is impermeable, and is adapted to prevent deterrent spray 106 from reaching the end user 200. The shield 116 is affixed to a plurality of shield supports 117. The shield supports 117 are rotatably engaged to shield pivot points 118 provided adjacent the spray nozzle 107.

Each of the plurality of shield supports 117 is affixed to one of a plurality of extension rods 119. The plurality of extension rods 119 is affixed to the plurality of shield supports 117. The plurality of extension rods 119 pivots with respect to the plurality of shield supports 117 via a rod pivot extends to and pivots with respect to a locking collar 121. The locking collar 121 includes a plurality of collar pivoting points 122 where the plurality of extension rods 119 pivot. The locking collar 121 is able to slide back and forth along the cane shaft 101.

The locking collar 121 includes a spring-loaded collar button 123 that is able to secure into one of a plurality of lock holes 124 provided on the cane shaft 101. The plurality of lock holes 124 enable the locking collar 121 to secure at varying locales along the cane shaft 101 in order to either lock open or collapse the shield 116. The locking collar 121 is used to deploy and retract the shield 116 (see FIGS. 2 and 3). The shield 116 and the locking collar 121 work in a manner analogous to an umbrella, but in a reversed configuration.

The plurality of collar pivoting points 122 are provided on a leading edge 125 of the locking collar 121. The leading edge 125 favors the bottom distal end 104 of the cane shaft 101. The shield 116 may be further defined with a shield diameter 126. The shield diameter 126 may not be larger than the cane length 105. It shall be noted that the spray nozzle 107 may be disassembled from the bottom distal end 104 of the cane shaft 101 in order to remove and replace the replaceable canister 108 from within the cane shaft 101. The locking collar 121 may be the cane shaft 101. The cane shaft 101 may include external threading 127 that corresponds with internal threading 128 provided on the spray nozzle 107.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A walking aid with deterrent spray comprising:
- a walking cane that is able to dispense a deterrent spray;
- wherein the walking cane includes a deployable shield that is adapted to protect an end user from deterrent spray;
- wherein the walking cane is further defined with a cane shaft with a handle portion provided at a top distal end of the cane shaft;
- wherein the cane shaft is also further defined with a bottom distal end;
- wherein the deterrent spray is adapted to be dispensed onto a feral animal;
- wherein the cane shaft includes a spray nozzle that is provided at the bottom distal end; wherein the spray nozzle is able to dispense the deterrent spray;
- wherein the spray nozzle is in fluid connection with a replaceable canister that is located within the cane shaft;
- wherein the replaceable canister is positioned behind the spray nozzle;
- wherein the replaceable canister includes a spring-actuated stem that upon depression releases the deterrent spray from the replaceable canister and out the spray nozzle;
- wherein the replaceable canister is actuated via a linkage that extends from the top distal end of the cane shaft; wherein the linkage includes a cam that engages a top canister surface of the replaceable canister.

2. The walking aid with deterrent spray according to claim 1 wherein the cane shaft is partially or wholly of hollowed construction.

3. The walking aid with deterrent spray according to claim 2 wherein the cane shaft is further defined with a shaft length.

4. The walking aid with deterrent spray according to claim 3 wherein the linkage is attached to a trigger provided adjacent the handle portion.

5. The walking aid with deterrent spray according to claim 4 wherein the trigger pivots at a trigger pivot point; wherein the trigger is biased via a trigger spring located within the cane shaft; wherein the trigger is responsible for operation of the replaceable canister.

6. The walking aid with deterrent spray according to claim 5 wherein the cane shaft also features the shield; wherein the shield is able to expand and collapse, and vice versa.

7. The walking aid with deterrent spray according to claim 6 wherein the shield is a conically-shaped canopy that is impermeable, and is adapted to prevent deterrent spray from reaching the end user; wherein the shield is affixed to a plurality of shield supports.

8. The walking aid with deterrent spray according to claim 7 wherein the shield supports are rotatably engaged to shield pivot points provided adjacent the spray nozzle.

9. The walking aid with deterrent spray according to claim 8 wherein each of the plurality of shield supports is affixed to one of a plurality of extension rods; wherein the plurality of extension rods is affixed to the plurality of shield supports; wherein the plurality of extension rods pivots with respect to the plurality of shield supports via a rod pivot point.

10. The walking aid with deterrent spray according to claim 9 wherein each of the plurality of extension rods extends to and pivots with respect to a locking collar; wherein the locking collar includes a plurality of collar pivoting points where the plurality of extension rods pivot; wherein the locking collar is able to slide back and forth along the cane shaft.

11. The walking aid with deterrent spray according to claim 10 wherein the locking collar includes a spring-loaded collar button that is able to secure into one of a plurality of lock holes provided on the cane shaft; wherein the plurality of lock holes enable the locking collar to secure at varying locales along the cane shaft in order to either lock open or collapse the shield; wherein the locking collar is used to deploy and retract the shield.

12. The walking aid with deterrent spray according to claim 11 wherein the plurality of collar pivoting points are provided on a leading edge of the locking collar; wherein the leading edge favors the bottom distal end of the cane shaft; wherein the shield is further defined with a shield diameter; wherein the shield diameter is not larger than the cane length.

13. The walking aid with deterrent spray according to claim 12 wherein the spray nozzle is able to be disassembled from the bottom distal end of the cane shaft in order to remove and replace the replaceable canister from within the cane shaft; wherein the locking collar is pushed forward, and the spray nozzle is threaded onto the cane shaft; wherein the cane shaft includes external threading that corresponds with internal threading provided on the spray nozzle.

* * * * *